US005549510A

United States Patent [19]

Fukuda et al.

[11] Patent Number: 5,549,510

[45] Date of Patent: Aug. 27, 1996

[54] ENDLESS POWER TRANSMISSION BELT PROCESSING APPARATUS, A GRINDING WHEEL THEREFOR, AND A METHOD OF USING THE ENDLESS POWER TRANSMISSION BELT PROCESSING APPARATUS

[75] Inventors: Misao Fukuda, Miki; Yoshihiro Hayami, Amagasaki; Toshihiro Ueda, Iwakura; Shoichi Iwaki, Kobe, all of Japan

[73] Assignee: Mitsuboshi Belting Ltd., Kobe, Japan

[21] Appl. No.: 985,622

[22] Filed: Mar. 12, 1993

Related U.S. Application Data

[63] Continuation-in-part of Ser. No. 798,636, Nov. 26, 1991, Pat. No. 5,234,382.

[30] Foreign Application Priority Data

Mar. 11, 1992 [JP] Japan ..... 4-088010
Jul. 31, 1992 [JP] Japan ..... 4-225037

[51] Int. Cl.[6] ..... B24B 3/00

[52] U.S. Cl. ..... 451/246; 451/51; 451/189; 451/184; 451/547; 264/162

[58] Field of Search ..... 451/28, 178, 184, 451/189, 209, 242, 526–530, 547, 540, 541, 51, 188, 246; 264/162

[56] References Cited

U.S. PATENT DOCUMENTS 3,468,583 9/1969 Austin ..... 451/547
3,743,152 7/1973 Greeves ..... 226/19
3,891,405 6/1975 Huber ..... 51/105 R
3,898,772 8/1975 Sawluk ..... 451/547
3,973,446 8/1976 Vasilatone ..... 74/241
4,561,757 12/1985 Salomon et al. ..... 355/3 BE

FOREIGN PATENT DOCUMENTS

0050173A1 4/1982 European Pat. Off. .
2117289 10/1983 United Kingdom .

OTHER PUBLICATIONS

P. 1/1—Patent Abstracts of Japan—Publication No. JP61100375—Dated May 19, 1986—Application NO. JP840215772–Application Date Oct. 15, 1984.
P. 1/1—Patent Abstracts of Japan—Publication No. JP1127263—Dated May 19, 1989—Application No. JP870282699—Application Date Nov. 9, 1987.
P. 1/1—Patent Abstracts of Japan—Publication No. JP62199319—Dated Sep. 3, 1987—Application No. JP860042398—Application Date Feb. 26, 1986.

*Primary Examiner*—Bruce M. Kisliuk
*Assistant Examiner*—Eileen P. Morgan
*Attorney, Agent, or Firm*—Wood, Phillips, VanSanten, Clark & Mortimer

[57] ABSTRACT

A grinding wheel for treating a surface of a power transmission belt/belt sleeve. The grinding wheel has a cylindrical body defining a rotational axis and having a circumferential outer surface with there being a plurality of abrading elements arranged in circumferentially spaced relationship on the outer surface of the body. Reliefs are provided between adjacent abrading elements. The invention further contemplates a method of treating a belt using the inventive grinding wheel.

16 Claims, 5 Drawing Sheets

FIG. 1
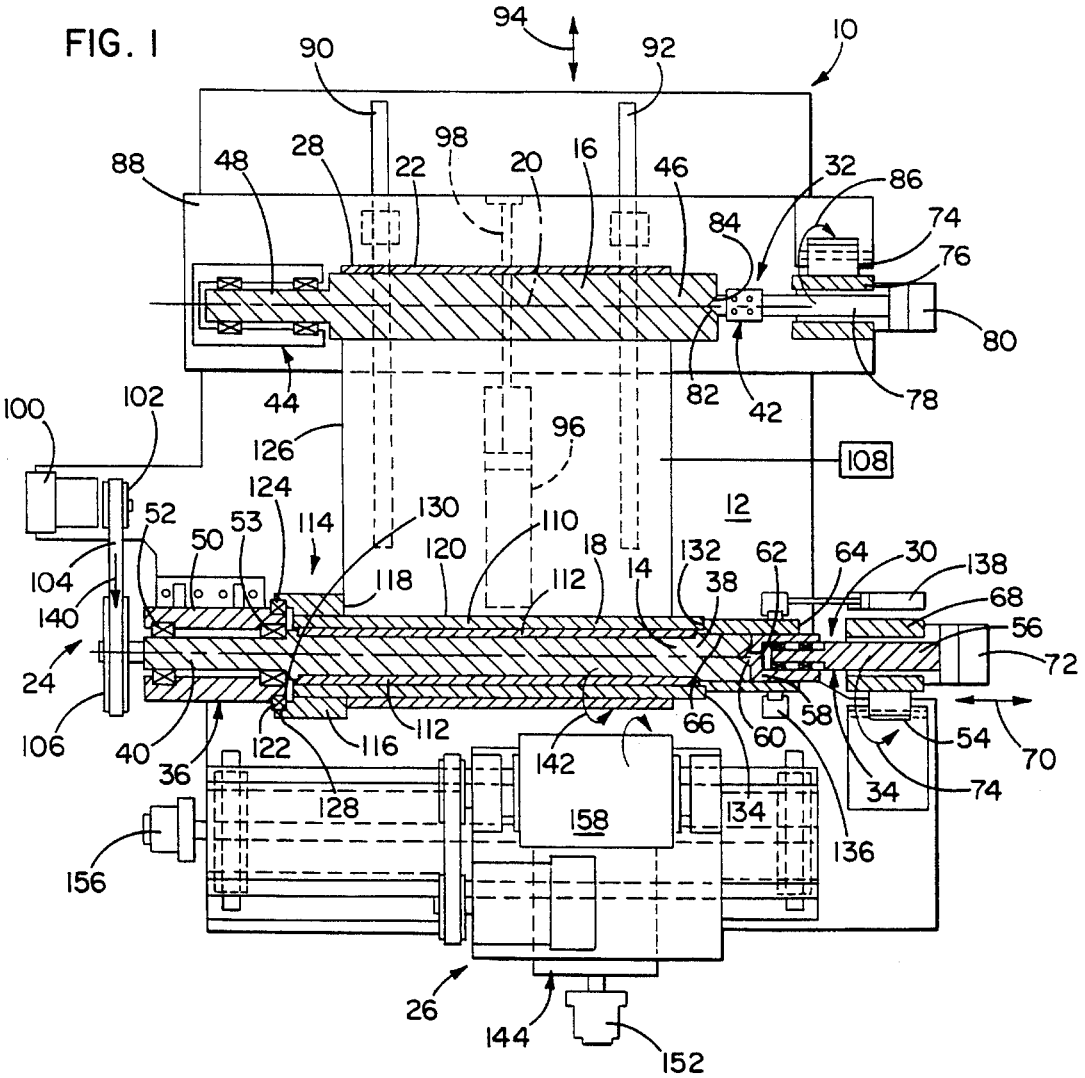
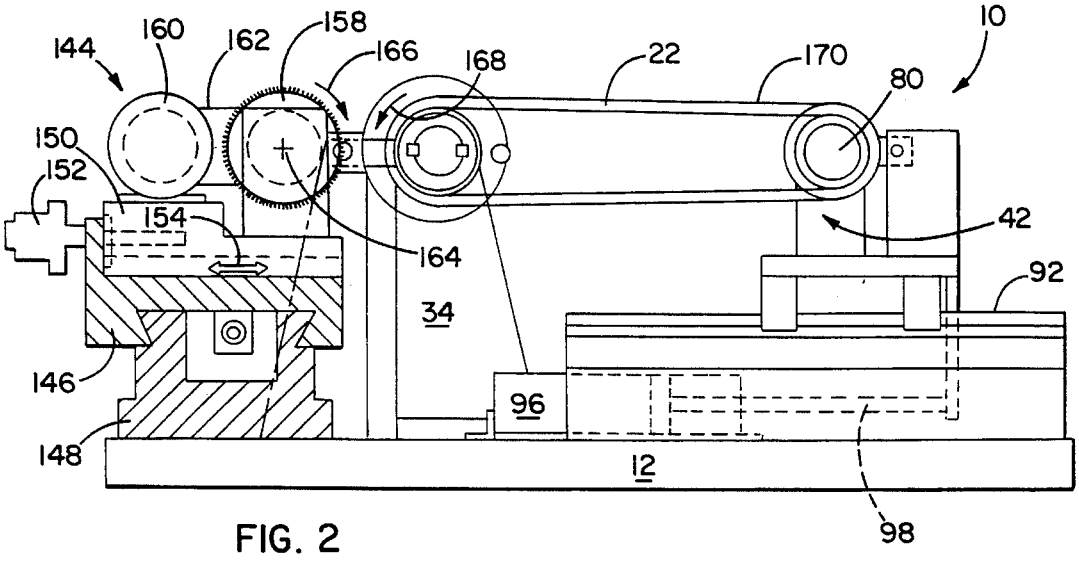
FIG. 2

FIG. 3
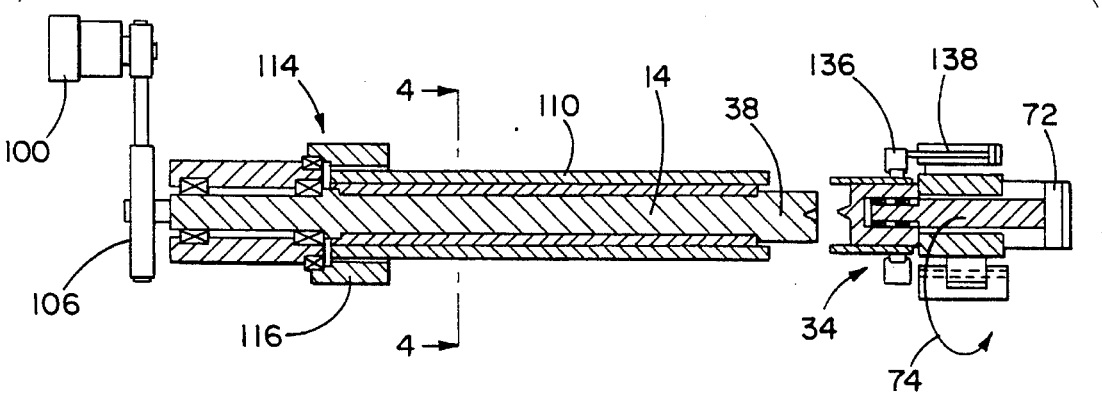
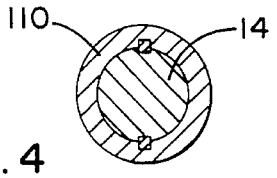
FIG. 4
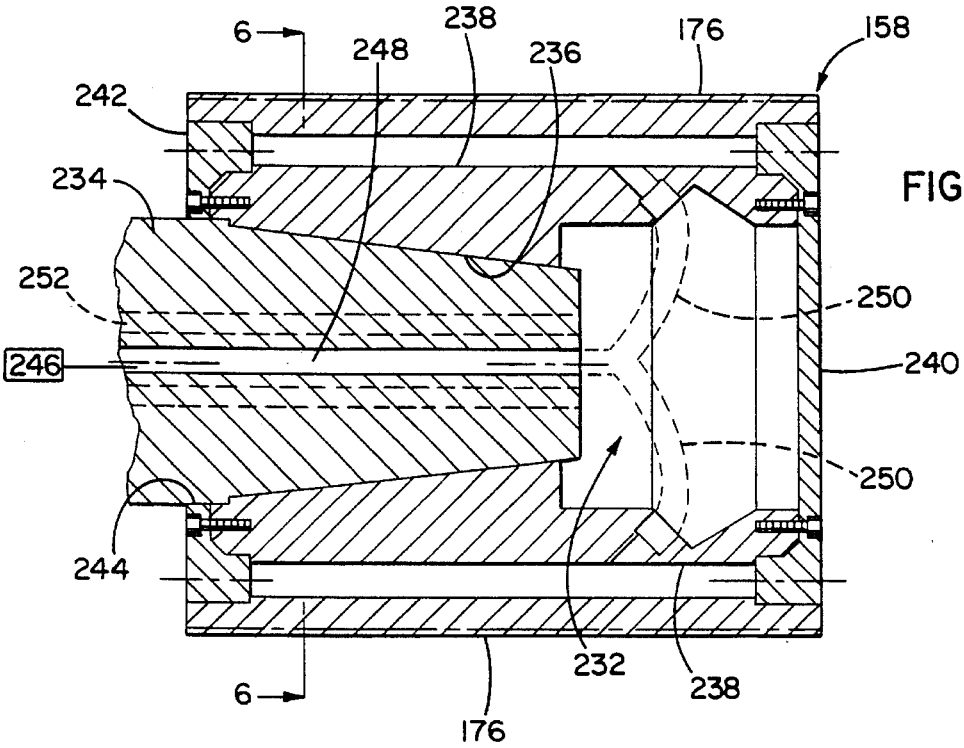
FIG. 5

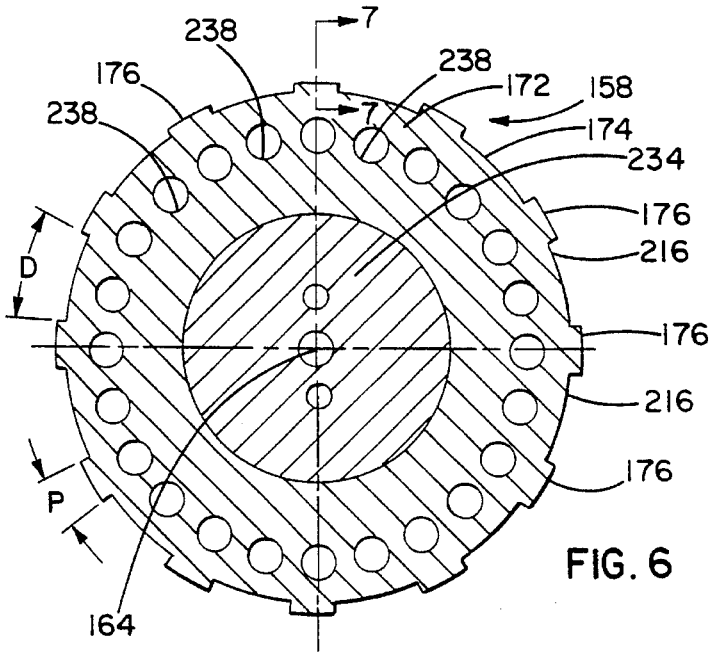
FIG. 6
FIG. 7
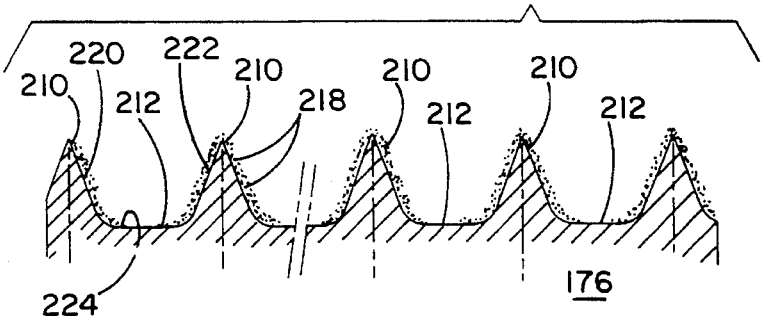
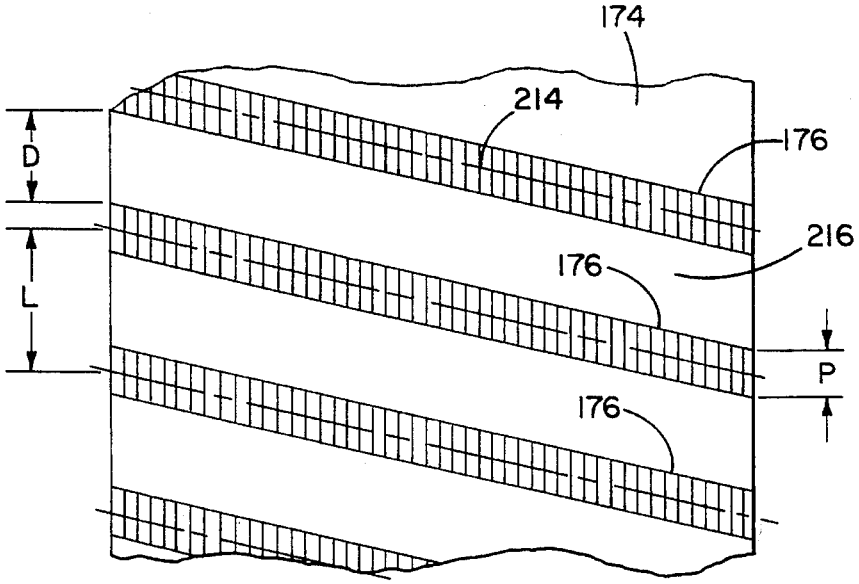
FIG. 8

ENDLESS POWER TRANSMISSION BELT PROCESSING APPARATUS, A GRINDING WHEEL THEREFOR, AND A METHOD OF USING THE ENDLESS POWER TRANSMISSION BELT PROCESSING APPARATUS

CROSS-REFERENCE

This application is a continuation-in-part of our application Ser. No. 798,636 filed Nov. 25, 1991, now U.S. Pat. No. 5,234,382 entitled "Endless Belt Deviation Preventing Unit and Belt Processing Apparatus Employing the Same Unit".

BACKGROUND OF THE INVENTION

1. Field of the Invention

This invention relates to an apparatus on which an endless belt/belt sleeve is mounted for rotational movement in an endless path around spaced rollers to allow a cutting/grinding operation to be performed thereon and, more particularly, to an apparatus which limits deviation of the endless belt/belt sleeve from a desired rotational path. This invention further relates to a grinding wheel for treating a surface of a power transmission belt/belt sleeve as, for example, the back surface of an endless belt/belt sleeve trained to rotate stably around spaced rollers and, more particularly, to a grinding wheel which effects precise treatment of a power transmission belt while minimizing heat generation. This invention is still further directed to a method of using the belt processing apparatus, including a grinding wheel that is a part thereof.

2. Background Art

It is known to fabricate power transmission belts, such as multi-ribbed belts, by sequentially building components inside out on a forming drum/mandrel. More particularly, a canvas layer, outer tension rubber layer, load carrying section and inside compression rubber layer are placed in turn on the forming drum to define a belt sleeve which is thereafter vulcanized. It is also known to rotate an endless sleeve formed by this method on a forming drum and to define V-shaped grooves in the rotating belt sleeve by means of a grinder having a cylindrical cutting surface that is complementary to the desired groove configuration in the belt sleeve. An exemplary system of this type is shown in Japanese Patent Publication No. 52-17552.

Multi-ribbed belts are commonly used in drive systems such as serpentine drive systems in automobiles. Typically, one very long belt drives numerous belt components. Since it would be impractical to use a forming drum to support such a belt/belt sleeve, in that the radius would be unduly large, such belts are commonly formed by training a belt/belt sleeve around spaced rollers having parallel axes. One or both of the rollers are driven to effect rotation of the belt/belt sleeve. The belt grooves are formed in the belt/belt sleeve using a grinding wheel similar to that used in forming side edges and grooves in a belt/belt sleeve carried by a forming drum. One of the rollers serves as a backing surface for the grinding wheel.

The above two forming methods are utilized not only on multi-ribbed belts but also to define the side surfaces of a conventional V-belt and to separate the individual belts from the belt sleeve using a cutter blade.

The above two techniques are further utilized to grind the back surface of the belt sleeve to produce a uniform thickness for the belt sleeve and the belts ultimately separated therefrom.

Particularly in the latter technique, in order to uniformly produce high quality belts, it is important to limit the deviation of the endless belt/belt sleeve from a predetermined rotational path around the two rollers. This objective is commonly frustrated by the load-carrying cords defining the neutral belt axis. Typically, a plurality of laterally spaced load-carrying cords are embedded in a rubber layer. The individual cords are conventionally made from twisted fibers and naturally bias the belt in a direction that depends on the direction of winding i.e. whether the twisted cords are "S-type" or "Z-type". When an individual belt/belt sleeve is trained around spaced rollers, there is a tendency of the belt/belt sleeve to shift laterally depending upon the twist direction. Further, any inclination of the load-carrying cords can produce the same undesirable result.

The result of the above lateral shifting is that the individual belt dimensions may vary from one belt to the next. This problem is particularly prevalent using conventional grinding techniques. By such techniques, the grinding wheel is urged against the rotating belt sleeve to cut/grind a portion thereof. Once that portion of the belt sleeve is formed, the grinding structure is retracted and shifted laterally to progressively form the belt sleeve. As long as the grinding wheel or cutter is pressed against the belt sleeve, the lateral shifting is minimized. However, once the cutting/grinding element is retracted fully from the belt sleeve, there is a tendency of the freely rotating belt sleeve to shift laterally as a result of the bias from the load-carrying cords. Further, the cut/ground portion of the belt sleeve becomes more flexible than the remainder of the belt sleeve which may lead to shifting of the belt sleeve. The result of this is that the width of the belts and/or ribs cut/ground out of the belt sleeve may be irregular.

One proposed solution to the above problem has been to alternatingly wrap "S-type" and "Z-type" load-carrying cords during formation of the belt sleeve. While alternating cords can alleviate the shifting problem to a certain extent, it does not provide a solution in a belt sleeve wherein a cord is continuously wound. The cords are slightly inclined to produce a spiral arrangement which results in a lateral bias on the belt sleeve. In this case, the alternating arrangement of "Z-type" and "S-type" cords does not provide an adequate solution to belt deviation during belt rotation.

As an alternative solution, it is known to provide a raised crown on at least one of the rollers in the spaced roller pair. The crown surface tends to block lateral shifting of the belt/belt sleeve. However, there is also a tendency of the belt/belt sleeve to bend radially outwardly to conform to the crown surface. The result is deformation of the belt sleeve and the individual belts formed from that part of the belt sleeve adjacent to the laterally opposite edges thereof.

Accurate grinding of a power transmission belt/belt sleeve is also compromised due to the nature of the conventional grinding wheel. Typically, a grinding wheel body has ribs, which are triangularly-shaped in cross section, projecting radially outwardly therefrom, with there being grooves alternating with the ribs along the axial extent of the grinding wheel. The ribs and grooves extend uninterruptedly around the circumference of the body. The cross sections of the ribs and adjacent grooves are chosen to be complementary to the end configuration for the belt sleeve. Diamond particles, or other hard granular material, can be placed on the cutting surface to improve the cutting capabilities for the grinding wheel.

One particular problem with the conventional grinding wheel is that the rotating grinding wheel remains continuously in contact with the belt during treatment. Through friction, both the grinding wheel and belt become heated. This causes a situation referred to in the art as belt reversion. The heated belt expands and is ground in its expanded state. Once the treated belt contracts, the contour thereof varies. The result is that belts treated using conventional grinding wheels are inconsistently shaped, from one to the next.

A further problem with belt manufacture utilizing the conventional grinding wheel is that the heat generation and resulting expansion of the belt/belt sleeve cause binding between the belt/belt sleeve and grinding wheel. This necessitates greater power consumption to rotate the grinding wheel at the desired angular velocity. Alternatively, the grinding wheel is operated at a slower speed, in which event the grinding operation must proceed more slowly. Increased power consumption results and increases manufacturing costs.

SUMMARY OF THE INVENTION

The present invention is specifically directed to overcoming the above-enumerated problems in a novel and simple manner.

It is a principal objective of the present invention to provide a structure to support a belt/belt sleeve so that the belt/belt sleeve consistently and stably rotates without deviating from a desired path and to at the same time reduce heat generation during treatment of one of the belt surfaces through a rotary grinding wheel. It is thus possible to treat a belt/belt sleeve surface precisely, quickly, and under minimal loading, resulting in reduced energy consumption compared to the prior art.

More particularly, one aspect of the present invention is the provision of a grinding wheel for treating a surface of a power transmission belt. The grinding wheel has a cylindrical body defining a rotational axis and having a circumferential outer surface with there being a plurality of abrading elements arranged in circumferentially spaced relationship on the outer surface of the body. Reliefs are provided between adjacent abrading elements.

The reliefs allow momentary release of pressure on a power transmission belt surface being treated by the grinding wheel to limit belt deformation and thereby facilitate a desired accurate treatment of the belt surface.

The abrading elements can take a number of different forms to perform different functions. The abrading elements can effect simple polishing, leveling, or individual belt rib formation. In the case of belt rib formation, typically the abrading elements will each have ribs and grooves alternating axially relative to the body to be complementary to a belt that is formed.

In one form, the outer surface of the grinding wheel body has an axial extent and the plurality of abrading elements extend substantially the full axial extent of the outer surface. The abrading elements may each extend uninterruptedly over their full axial extent.

In one form, each of the abrading elements extend substantially in a straight line that is non-parallel to the axis of the grinding wheel body.

In one form, each of the plurality of abrading elements has a circumferential length (P), each of the reliefs has a circumferential length (D), and the circumferential length (P) of the abrading elements is from 10–50% of the circumferential pitch length (L) for the abrading elements, where L=P+D. More preferably, the circumferential length (P) is from 30–40% of the circumferential pitch length.

With the above structure, effective grinding of the belt/belt sleeve occurs without excessive resistance between the grinding wheel and belt/belt sleeve. The reliefs avoid excessive heat generation and belt expansion during the treatment of the belt. Accordingly, the belt does not significantly distort through heat buildup during the treating process and thus consistent formation of the belt/belt sleeve can occur. By reducing loading on the grinding wheel, the grinding wheel can be rotated at high speeds with minimal energy consumption. Deformation of the belt during treatment is minimized so that consistent, high speed precision grinding can be carried out.

Further enhanced grinding is realized through various other aspects of the invention. In one form, heat buildup is further limited by providing structure to direct a cooling fluid in a prescribed path through at least one of the grinding wheel body and abrading elements. The cooling fluid is preferably continuously circulated through the one of the body and abrading elements. By reducing heat generation, deformation of the belt/belt sleeve is minimized and the life of the grinding wheel is prolonged.

To further enhance cutting, granular material can be applied to the abrading elements. In one form, the granular material is diamond having a mesh size of 100 to 120 microns. The granular material is applied at least to the ribs and grooves on the abrading elements. The granular material accounts for the belt/belt sleeve and grinding wheel being cooler during treatment, which lengthens the life of the grinding wheel as well as resulting in more precise grinding.

To further optimize abrading capability while minimizing energy consumption, the leading edges of the abrading elements are inclined to be non-parallel to a radial line from the axis of the body. Preferably the angle between the incline on the leading edges and the radial line is less than 45°.

To further enhance abrading capabilities, granular material can be applied to the leading edge of the abrading elements. The inclination of the leading edges affords a larger surface area to accept the granular material.

The invention further contemplates a grinding wheel having a body defining a rotational axis and having a circumferential outer surface, and an abrading element on the outer surface of the body for engagement with a power transmission belt to be treated by the grinding wheel. The abrading element is non-continuous around the outer surface of the body to define at least one relief which allows momentary release of pressure on a belt surface being treated.

With the grinding wheel used for belt formation, the abrading element has at least two ribs spaced axially with respect to the grinding wheel body to define a rib on a power transmission belt.

The invention further contemplates a method of treating a surface of a power transmission belt/belt sleeve, which method includes the steps of rotating a belt/belt sleeve in an endless path so as to expose a surface thereon to be treated, providing a grinding wheel with an abrading element thereon, rotating the grinding wheel about an axis, advancing the rotating grinding wheel towards the belt/belt sleeve so that the abrading element and belt/belt sleeve are in a first relative position and the abrading element is urged against the belt with a predetermined force, and intermittently reducing the force applied to the belt/belt sleeve by the abrading element with the abrading element and belt/belt sleeve in the first relative position to thereby facilitate a desired accurate treatment of the belt/belt sleeve surface.

In one form the grinding wheel has a circumferential outer surface with the abrading element thereon so that the abrading element is non-continuous around the outer surface of the body to define at least one relief.

In one form, there are a plurality of abrading elements with reliefs therebetween. The relationship between the abrading elements and reliefs can be as described above for the grinding wheel.

The grinding wheel can be at least partially covered with a granular material before grinding to enhance its cutting ability.

The grinding wheel is preferably rotated at 400–2000 rpm.

The grinding wheel and belt/belt sleeve can be rotated in the same or in opposite directions.

The grinding wheel can be continuously cooled during the treatment process to avoid expansion of the belt/belt sleeve. In one form, the grinding wheel has a rotatable shaft. Cooling fluid is directed controllably through the shaft and into heat exchange relationship with at least one of the body and abrading elements.

Further according to the invention, an apparatus is provided for limiting deviation of an endless belt/belt sleeve from a desired rotational path. The apparatus has first and second rollers each having a rotational axis and cooperatively supporting an endless belt/belt sleeve trained therearound for rotational movement in a predetermined path. A first member is mounted on one of the first and second rollers for movement axially relative to the one of the first and second rollers. A blocking structure defines a shoulder for engagement with an edge of an endless belt/belt sleeve trained around the first and second rollers to limit movement of an endless belt trained around the first and second rollers in a first axial direction relative to the one of the first and second rollers.

With the above structure, an endless belt/belt sleeve that is trained around the first and second rollers and shifts axially relative to the one of the first and second rollers in the first axial direction encounters the shoulder on the blocking structure and is resultingly caused to be urged oppositely to the first axial direction and the first member moves oppositely to the first axial direction relative to the one of the first and second rollers to thereby relieve an axial force exerted on the shoulder by the belt/belt sleeve to thereby keep the belt/belt sleeve in a desired axial position in which the belt/belt sleeve contacts the shoulder with only a slight axial pressure. By preventing axial shifting of the belt/belt sleeve, consistent abrasion and/or cutting of the back surface of the belt can be carried out sequentially to result in the production of consistently precision, high quality belts.

In one form of the invention, the first member is a sleeve that surrounds the one of the first and second rollers.

In a preferred form, the sleeve and the one of the first and second rollers are guided for relative axial movement by cooperating splines.

The blocking structure is preferably a collar that surrounds at least one of the first and second rollers and the first member. The collar is mounted for rotation relative to the one of the first and second rollers about a third axis.

In a preferred form, a frame is provided. There is supporting structure on the frame to maintain each of the first and second rollers in an operative position. There is further structure for moving at least one of the first and second rollers selectively towards and away from the other of the first and second rollers to allow selection of a desired tension on an endless belt/belt sleeve trained around the first and second rollers.

To facilitate placement of an endless belt/belt sleeve on, and removal of a belt/belt sleeve from, the first and second rollers, a support is provided at each axial end of the first roller. The support is movable between an operative position and a setup position, with the latter allowing placement of the belt/belt sleeve over the rollers and removal of the belt/belt sleeve from the rollers. Preferably, the movement of the support is a pivoting movement. In a preferred form, a movable support is provided at the same axial end of each of the first and second rollers.

With the inventive structure, a belt/belt sleeve is mounted around the first and second rollers by repositioning one or both of the roller supports to a setup position. With the belt/belt sleeve trained around the first and second rollers, the support(s) can be placed back in an operative position. The spacing of the first and second rollers can be selected to place a predetermined tension on the belt/belt sleeve. The belt/belt sleeve is urged by an aligning sleeve into abutting relationship with the shoulder on the collar. A predetermined pressure is applied to the aligning sleeve as through an hydraulic cylinder. The shoulder on the collar counteracts belt/belt sleeve movement axially toward the shoulder and shifts the first member/sleeve to relieve the axial force exerted by the belt/belt sleeve to thereby keep the endless belt/belt sleeve in its desired original position so that the belt/belt sleeve is consistently rotated in a desired rotational path in which the belt/belt sleeve contacts the collar shoulder with only a slight axial pressure. A pressure produced by the aligning sleeve is chosen to be sufficient to maintain the belt/belt sleeve edge in contact with the shoulder on the blocking collar. The belt/belt sleeve can then be consistently ground/cut in steps as it is rotated.

BRIEF DESCRIPTION OF THE DRAWINGS

FIG. 1 is a plan view of an apparatus for limiting deviation of an endless belt/belt sleeve from a desired rotational path according to the present invention;

FIG. 2 is a side elevation view of the apparatus in FIG. 1;

FIG. 3 is a plan view of a roller on the apparatus of FIGS. 1 and 2 for supporting an endless belt/belt sleeve and showing a support at one end of the roller in a retracted position;

FIG. 4 is a cross-sectional view of the roller taken along line 4—4 of FIG. 3;

FIG. 5 is an enlarged, cross-sectional view of a grinding wheel according to the present invention useable to grind an endless belt rotated on the apparatus in FIGS. 1 and 2;

FIG. 6 is a cross-sectional view of the grinding wheel taken along line 6—6 of FIG. 5;

FIG. 7 is an enlarged cross-sectional view of abrading elements on the grinding wheel taken along line 7—7 of FIG. 6;

FIG. 8 is a fragmentary plan view of the abrading elements on the grinding wheel of FIGS. 5 and 6;

DETAILED DESCRIPTION OF THE DRAWINGS

Figure 9:
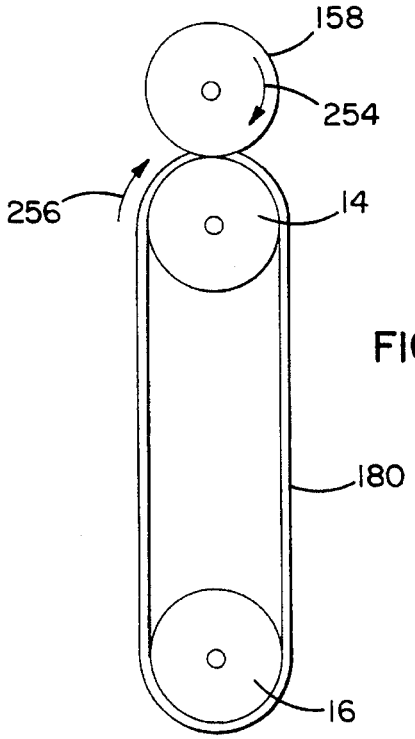
FIG. 9 is a schematic plan view of a belt sleeve trained around a pair of spaced rollers and showing the relationship between the rotatable belt sleeve and a grinding wheel according to the present invention.

A preferred form of apparatus for limiting deviation of an endless belt/belt sleeve from a desired rotational path, according to the present invention, is shown at 10 in FIGS. 1–4. The apparatus consists of a frame 12 upon which first and second rollers 14, 16, respectively, are mounted. Each of the rollers 14, 16 has a rotational axis 18, 20, respectively, with the axes 18, 20 of the rollers 14, 16 being in spaced, parallel relationship so that an endless belt sleeve 22 can be trained therearound to rotate in a desired path.

Typically, the belt sleeve 22 is defined by sequentially building components up on a forming drum in inside out relationship, as described in greater detail below. The belt sleeve 22 is then trained around the rollers 14, 16 and drawn to a predetermined tension. The first roller 14 is rotated by a drive mechanism 24. As the belt sleeve 22 is rotated, a grinding/cutting means 26, also mounted on the frame 12, is used to grind/cut the outside surface 28 of the belt sleeve 22 as to produce a uniform thickness for the belt sleeve 22, cut ribs in a multi-ribbed belt, and/or cut individual belts from the belt sleeve 22.

One aspect of the invention is a novel supporting structure for the belt sleeve 22. More particularly, the first roller 14 is mounted by a supporting means 30 and the second roller 16 by a supporting means 32 above the frame 12. The supporting means 30 has spaced supports 34, 36 for the opposite axial ends 38, 40 of the roller 14. Similarly, the supporting means 32 has supports 42, 44 for the spaced axial ends 46, 48 of the roller 16.

The end 40 of the roller 14 has a reduced diameter and is journalled for rotation in a bearing 50 on the support 36 by axially spaced idler rollers 52, 53.

The support 34 for the roller end 38 is releasable therefrom to allow mounting/dismounting of the belt sleeve 28 and/or disassembly of the roller 14. The support 34 has a base 54 which carries an elongate spindle 56 which supports the roller end 38. The spindle 56 has an end fitting 58 thereon with a conical support nose 60 that is received in a conical recess 62 in the end 38 of the roller 14. An alignment sleeve 64 surrounds the end fitting 58 and is freely rotatable relative thereto. The inside surface 66 of the alignment sleeve 64 and end fitting 58 cooperatively define a receptacle for the end 38 of the roller 14.

The base 54 has a bearing 68 which guides translation of the spindle 56 in the line of double-headed arrow 70 between an extended position, shown in FIG. 1, and a retracted position, shown in FIG. 3. A drive 72 on the spindle 56 moves the spindle 56 selectively between its extended and retracted positions. With the spindle 56 retracted, the support 34 can be pivoted in the direction of arrow 74 to allow unimpeded access to the roller 14 as to allow mounting and dismounting of an endless belt sleeve 22 on the apparatus 10.

The support 42 has a corresponding base 74 carrying a bearing 76 to support a spindle 78 for lengthwise movement towards and away from the end 46 of the second roller 16. The movement of the spindle is accomplished by a drive 80. The spindle free end 82 is conical for reception in a correspondingly configured recess 84 in the roller end 46. With the spindle 78 retracted from the position of FIG. 1, the support 42 can be pivoted in the direction of arrow 86 to a setup position in which access to the roller end 46 is unimpeded.

Mounting and dismounting of the belts is accomplished by first retracting each of the spindles 56, 78 and placing each of the supports 34, 42 in a setup position. The belt sleeve 22 can then be trained around the rollers 14, 16 after which the supports 34, 42 can be resituated to an operative position (see FIG. 1), after which the drives 72, 80 press the spindles 56, 78 against the ends 38, 46 of rollers 14, 16, respectively, so that the rollers 14, 16 are positively supported for rotation about their respective axes 18, 20.

The supporting means 32 includes a base 88 which is guided by spaced rails 90, 92 for translatory movement in the line of double-headed arrow 94. An hydraulic drive 96 has a drive cylinder 98 connected to the base 88 to drive the base 88 selectively towards and away from the roller 14. Once the belt sleeve 22 is trained around the rollers 14, 16, the drive 96 can be operated to place a desired tension on the belt sleeve 22.

To control the tension on the belt sleeve 22, an optional tensioning roller, shown schematically at 108, can be provided. The tensioning roller 108 acts on an unsupported portion of the belt sleeve 22 between the rollers 14, 16.

The drive mechanism 24 for the belt sleeve 22 consists of a drive motor 100 carrying a pulley 102 which drives a belt 104 trained around a pulley 106 mounted on the end 40 of the roller 14. The belt 104 is preferably a toothed belt for positive force transmission.

In the preferred embodiment, structure for limiting deviation of the belt sleeve 22 from a desired rotational path is provided on the roller 14. It should be understood that this structure could alternatively be provided on the roller 16 or on both of the rollers 14, 16.

More particularly, the inventive structure for preventing belt deviation includes a first member/sleeve 110 which surrounds the roller 14 and is keyed thereto against rotation as by splines 112 so that the sleeve 110 is slidable axially relative to the roller 14.

A belt blocking means is provided at 114 in the form of a cylindrical collar 116 having an axially facing blocking shoulder 118. The collar 116 surrounds the sleeve 110 adjacent to the end 40 of the collar 14. The collar 116 is spaced slightly in a radial direction from the outer surface 120 of the sleeve 110 so that the collar 116 is freely rotatable around the sleeve 110. The collar 116 is guided in rotation relative to the bearing 50 by an idler roller 122 interposed between the bearing 50 and an undercut surface 124 on the collar 116.

With the belt sleeve 22 operatively positioned on the rollers 14, 16, the collar shoulder 118 abuts the free edge 126 of the belt sleeve 22. As the belt sleeve rotates in operation, it causes the collar 116 to rotate about the axis 18. The collar 116 is prevented from moving axially towards the left in FIG. 1 by an annular shoulder 128 thereon, which abuts the idler roller 122 which, in turn, abuts an annular shoulder 130 on the bearing 50.

Upon the belt sleeve 22 drifting axially towards the left in FIG. 1, the edge 126 of the belt sleeve 22 bears against the collar shoulder 118. The shoulder 118 produces a counteractive axial force that tends to shift the sleeve 110 slightly relative to the roller 14 toward the right to relieve the axial pressure exerted by the belt/belt sleeve 22 on the position in which the belt sleeve 22 on the shoulder 118 to thereby keep the belt sleeve 22 in its desired original position in which the belt sleeve 22 contacts the shoulder 118 on the collar 116 with only a slight axial pressure sufficient to maintain the desired axial alignment of the sleeve 22.

It should be understood that while the collar 116 and blocking shoulder 118 defined thereby are shown at the end 40 of the roller 14, a like structure could be provided alternatively on the end 48 of the roller 16. A blocking collar could also be provided on each of the rollers 16, 18. A still further modification contemplated by the invention is the provision of a blocking shoulder at a location between, rather than on, the rollers 14, 16. The location of the shoulder 118 in FIG. 1 is preferred because a more positive force can be transmitted to the sleeve 110 with this arrangement so that the system is more sensitive and responsive to even minor belt deviations.

On the other end 38 of the roller 14, the alignment sleeve 64 prevents "walking" of the sleeve 110 as might otherwise be caused by system vibrations. The alignment sleeve 64 has an annular shoulder 132 which abuts a facing shoulder 134 on the sleeve 110. A control ring 136 surrounds the alignment sleeve 64 and is connected thereto so that the alignment sleeve 64 is freely rotatable relative to the ring 136 and follows axial movement of the ring 136. An hydraulic cylinder 138 selectively moves the control ring in the axial direction, indicated by double-headed arrow 70. The cylinder 138 causes a predetermined force to be exerted on the ring 136, and thus in turn the alignment sleeve 64, which is overcome by the counteractive force exerted by the shoulder 118 on the collar 116 upon the belt sleeve 22 deviating towards the left in FIG. 1. The force exerted by the cylinder 138 is sufficient to keep the sleeve 110 and belt sleeve 22 thereon in their desired axial position and, as previously mentioned, prevents axial movement of the sleeve 110 as when the sleeve 110 is subjected to vibrations during operation.

It should be understood that the sleeve 110 and related structure could be provided on the roller 16 instead of the roller 14 or, alternatively, such structure can be provided on both rollers 14, 16 in accordance with the present invention.

The operation of the apparatus 10 is as follows. The roller 16 is moved by the drive cylinder 98 towards the roller 14. The spindles 56, 78 are then retracted so that the supports 34, 42 can be moved to their setup position.

The belt sleeve 22 is then trained around the rollers 14, 16. The supports 34, 42 are returned to their operating position after which the spindles 56, 78 are extended to engage the ends 38, 46 of the rollers 14, 16, respectively, to thereby support the spindles 14, 16 securely for rotation about their axes 18, 20. At the same time, the cylinder 138 is operated to bring the alignment sleeve 64 into engagement with the sleeve 110 to thereby cause the edge 126 of the belt sleeve 22 to engage the shoulder 118 on the collar 116.

To tension the belt, the drive 96 is operated to move the base 88 away from the roller 14. Once the belt sleeve 22 is properly tensioned, the drive mechanism 24 is operated to move the belt sleeve 22 in the desired rotational path. The drive mechanism 24 moves the belt 104 in the direction of arrow 140 to thereby rotate the roller 14 in the direction of arrow 142.

Once the belt sleeve 22 deviates, i.e. moves towards the left in FIG. 1, a force is imparted by the sleeve edge 126 against the shoulder 118. This force is relieved by the shifting of the sleeve 110 alone toward the right against the force of the cylinder 138 to thereby maintain the belt sleeve in its desired original position. Accordingly, the belt sleeve 22 can be consistently maintained in its desired original position in which the belt sleeve 22 contacts the shoulder 118 on the collar 116.

The system is arranged so that it counters belt deviation towards the left in FIG. 1. The belt sleeve 22 is thus mounted so that it naturally tends towards the left in FIG. 1. To ascertain the direction that a belt will deviate towards, the winding pattern for the load-carrying cords in the belt sleeve 22 is predetermined. A visual inspection of the belt will reveal this direction or, alternatively, a mark can be made on the belt sleeve 22 to indicate the direction of deviation during manufacture.

Dismounting of the belt sleeve 22 is accomplished by reversing the mounting steps. The spindle 56 must be retracted sufficiently that the alignment sleeve 64 is axially spaced from the end 38 of the roller 14.

The invention also contemplates the combination of the above described structure with a belt processing apparatus, shown at 144 in FIG. 1. The belt processing apparatus 144 may be a cutting or grinding mechanism to produce a uniform width belt, define ribs in a multi-ribbed belt, or define the side edges of individual V-belts.

More particularly, the belt processing apparatus 144 consists of an X-axis base 146 that is guided relative to a frame part 148 parallel to the roller axes 18, 20 and a Y-axis base 150 that is movable relative to the X-axis base 146 through a pulse motor 152 perpendicular to the roller axes 18, 20, as indicated by double-headed arrow 154. The X-axis base 146 is movable by a pulse motor 156.

The Y-axis base 150 carries a rotatable grinding wheel 158 which is driven by a motor 160 through an endless belt 162. The motor 160 drives the wheel about an axis 164 that is parallel to the axes 18, 20 of the rollers 14, 16 in the direction of arrow 166, which rotational direction is opposite to that for the rollers 14, as shown by arrow 168.

The belt processing apparatus 144 operates as follows. With the belt sleeve 22 mounted on the rollers 14, 16 and rotated by the drive mechanism 24, the grinding wheel 158 is caused to engage the outer surface 170 of the belt sleeve 22. At startup, the grinding wheel 158 is spaced slightly from the belt sleeve 22 on the roller 14 and moved by the motor 156 parallel to the roller axis 18 to align the grinding wheel 158 with that part of the belt sleeve 22 that is to be ground/cut. The motor 152 is then operated to move the grinding wheel 158 against the rotating belt sleeve 22 to effect the desired grinding/cutting. Once the grinding/cutting is completed, the motor 152 is operated to retract the grinding wheel 158. The motor 156 is then operated to move the grinding wheel axially relative to the roller 14 and the process repeated to sequentially grind/cut the belt sleeve 22.

In a preferred form, the outer surface 120 of the sleeve 110 is coated with an elastic element (not shown) such as rubber, which facilitates cutting entirely through the belt sleeve 22 without damaging the sleeve 110, as when individual belts are being separated from the belt sleeve 22.

Still another aspect of the invention is a particular form of grinding wheel 158, shown in FIGS. 5–13. The grinding wheel 158 has a cylindrical body 172 with a circumferential outer surface 174 from which a plurality of abrading elements 176 project in a radial direction. The abrading elements 176 are spaced equidistantly around the periphery of the surface 174.

The abrading elements 176 extends over substantially the entire axial extent of the outer surface 174 of the grinding wheel 158. The abrading elements 176 have a straight configuration with the line thereof being oriented to be non-parallel to the rotational axis 164 of the grinding wheel 158. However, the invention does contemplate that the line of the abrading elements 176 could be parallel to the axis 164.

The abrading elements 176 may have a cutting configuration that is flat, as to grind the back side, side surfaces, etc. of a power transmission belt. The cutting configuration disclosed in FIGS. 5–13 is designed to define individual belts from a belt sleeve. However, this exemplary embodiment should not be viewed as limiting.

Figure 10:
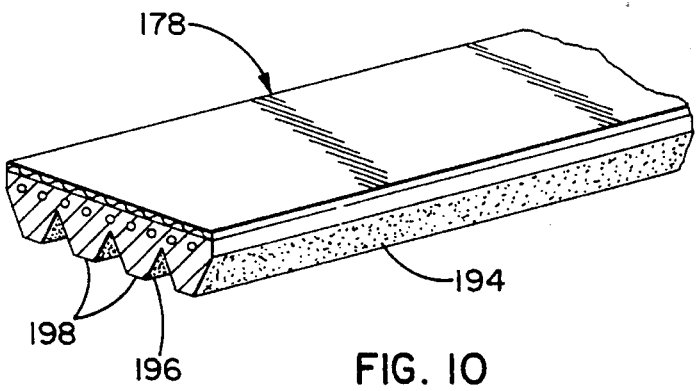
FIG. 10 is a perspective view of a section of a V-ribbed power transmission belt that can be made using the inventive grinding wheel and practicing the inventive method.

Before describing the details of the abrading elements 176, a suitable belt sleeve construction, to be operated upon by the inventive grinding wheel 158, will be described in detail, with reference specifically to FIG. 10.

Individual V-ribbed belts 178 are formed from a belt sleeve 180 built up in inside out relationship on the outer surface 182 of a forming drum/mandrel 184. The initial layer placed on the forming drum surface 182 is a cover canvas layer 186. While one layer 186 is shown, a plurality of cover canvas layers could be used to form a tension layer. A cushion rubber layer 188, spirally wound load carrying cords 190, and a compression rubber layer 192 are sequentially built up over the cover canvas layer 186 on the forming drum 184.

The compression rubber layer 192 has 1–15 volume % cut fibers 194 that project laterally of the belt 178. The fibers 194 are preferably aramid fiber, polyester fiber, nylon fiber, or cotton, and have a length of 1–10 mm. With all of the above components assembled on the forming drum 184, the belt sleeve 180 is vulcanized.

The belt sleeve 180 has a width sufficient to allow formation of several individual V-ribbed belts 178 from a single sleeve 180. The particular number formed is primarily a design consideration. The number of grooves 196 formed in the belt sleeve 180 may range, for example, from 3–100. The grinding wheel 158 is configured to cut the individual grooves 196 between adjacent ribs 198 on the belt 178. The configuration of the abrading element 176 to accomplish this will now be described.

Each abrading element 176 has triangular-shaped ribs 210 and grooves 212 alternating along the axial extent thereof. The ribs 210 and grooves 212 are complementary to the configuration of the grooves 196 and ribs 198 on the belt 178.

The equidistantly spaced abrading elements 176 have center lines 214 spaced from each other a distance L. Reliefs 216 are provided between adjacent abrading elements 176. The reliefs 216 have a circumferential length D. During processing, the forces between the grinding wheel 158 and belt/belt sleeve 178, 180 are momentarily released in the region of the reliefs 216. This construction reduces frictional forces between the grinding wheel 158 and belt/belt sleeve 178, 180 so that less energy is required to operate the grinding wheel 158 at high speeds. At the same time, heat buildup is minimized which contributes to the longevity of the grinding wheel 158 and also prevents expansion of the belt/belt sleeve 178, 180 during the treating operation. If the belt/belt sleeve 178, 180 expands due to heating, it may be ground in an expanded state. The configuration of the ground belt thus changes when it contracts as it cools. The result of this is inconsistent belt formation.

In a preferred form, the circumferential length (P) of each abrading element 176 is equal to 10–50% of the pitch length L (L=P+D). If the circumferential length P exceeds 50% of the pitch length L, the contact area and friction between the grinding wheel 158 and belt/belt sleeve 178, 180 is such that the belt/belt sleeve 178, 180 heats and therefore expands, which results in substantial binding to make high speed precision cutting, without excessive power consumption and grinding wheel wear, impossible. If the circumferential length P is less than 10% of the pitch length L, while the binding between the grinding wheel 158 and belt/belt sleeve 178, 180 is reduced, a longer processing time is required due to the reduced contact area between the abrading elements 176 and belt/belt sleeve 178, 180. Most preferably, the circumferential length P of the abrading elements 176 is in the range of 30–40% of the pitch length L.

The circumferential length D of the reliefs 216 remains preferably in the range of 50–90% of the pitch length L. The reliefs 216 intermittently afford stress relief as the grinding wheel 158 operates.

To enhance the cutting capability for the grinding wheel 158 and to improve the longevity thereof, granular material 218, such as diamond, or the like, is applied at least to the facing rib surfaces 220, 222 and the base wall 224 of the grooves 212. The granular material has a mesh size of 100 to 120 microns. Additionally, and more preferably, the granular material 218 is applied to the leading edges 226 of the ribs 210 with the grinding wheel advancing in the direction of arrow 228 in FIG. 12. The granular material 218 is also preferably applied to the apexes 230 of the ribs 210.

Figure 13:
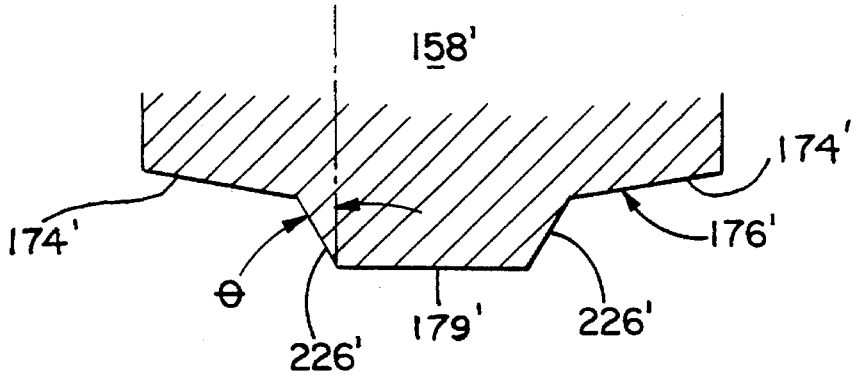
FIG. 13 is an enlarged cross-sectional view of a modified form of one of the abrading elements according to the present invention.

A modified form of abrading element is shown at 176' in FIG. 13. The leading edges 226', depending upon the direction of rotation of the grinding wheel 158', are inclined or swept back in a trailing direction as the leading edge extends from the circumferential outer surface so that the surface area thereof is increased over that which it would be if the edges 226' were parallel to a radial line through the rotational axis 164. This permits a greater amount of granular material 218 to be deposited onto the edges 226', to thereby enhance cutting ability and increase the longevity of the abrading elements 176. Preferably, the angle of inclination θ is no greater than 45°. If the angle θ is greater than 45°, the edges 226 are not situated to aggressively grind a belt/belt sleeve 178, 180 and thus grinding efficiency is diminished. Additionally, the abrading element 176' has a ridge 179' extending circumferentially from the leading edge 226' for a fixed distance. Finally, the abrading element 176' has a trailing edge 226' extending from the ridge 179' to the circumferential outer surface 174', with the trailing edge 226' being swept back in a trailing direction where the trailing edge 226' extends from the ridge 179' to the circumferential outer surface.

As shown in FIGS. 5 and 6, cooling means is provided at 232 to circulate a fluid, such as water or the like, through the body 172 in heat exchange relationship with the abrading element 176. By keeping the abrading elements 176 cooled, heat buildup on the belt/belt sleeve 178, 180 is avoided. Additionally, the life of the grinding wheel 158 is increased.

The grinding wheel 158 is mounted on a rotatable shaft 234. The grinding wheel body 172 has a stepped, central through bore 236 and, radially outwardly therefrom, a plurality of circumferentially and equidistantly spaced bores 238 defining fluid flow channels. An end cap 240 seals the bore 236 as well as the bores 238 radially outwardly therefrom at one end of the body 172. A separate end cap 242 seals the opposite ends of the bores 238 and has an opening 244 therethrough for close reception of the shaft 234.

Cooling fluid from a supply 246 flows into and through a bore 248 in the shaft 234 and into a plurality of curved pipes 250 which distribute the incoming fluid to the bores 238. The fluid flowing in the bores 238 is in heat exchange relationship with the abrading elements 176. The fluid then flows radially back inwardly through pipes (not shown) to an annular return passage 252 in the shaft 234 radially outwardly of the bore 248. The circulating fluid prevents overheating of the abrading elements 176 on the grinding wheel 158. It is thus possible to operate the grinding wheel 158 at high speeds without excessive heat generation which, in addition to prolonging the life of the grinding wheel, results in precision cutting/grinding.

In operation, the grinding wheel edges 226,226' with the granular material 218 thereon bite and grind the belt/belt sleeve 178, 180. Thereafter, the partially ground belt/belt sleeve 178, 180 moves into a relief 216 so that the stress thereon is relieved. This momentary stress relief allows the belt/belt sleeve 178, 180 that was deformed under the pressure of the abrading element 176 to regain its undeformed state. This occurs repeatedly upon rotation of the grinding wheel 158 until the belt/belt sleeve 178, 180 is fully formed. Because the belt/belt sleeve 178, 180 remains substantially unreformed during the treating operation, high precision grinding can occur. Due to the reduction in binding between the grinding wheel 158 and belt/belt sleeve 178, 180, the grinding wheel 158 is allowed to rotate at a greater rotational speed, without excessive energy consumption, to rapidly effect cutting of the belt/belt sleeve 178, 180.

The invention contemplates that the grinding wheel 158 can be rotated in the same direction or oppositely to the rotating belt sleeve 180. In FIG. 9, the grinding wheel 158 is rotated in the direction of arrow 254 and the belt sleeve 180 rotated in the direction of arrow 256 so that the grinding wheel 158 and belt sleeve 180 rotate against each other.

The rotational velocity of the belt sleeve 180 can vary over a wide range. The speed of the grinding wheel 158 is preferably in the range of 400–2000 rpm.

After the grinding wheel 158 fully treats the belt sleeve 180, the belt sleeve 180 can be disengaged from the rollers 14, 16 and mounted on a separate set of rollers (not shown), one of which is a drive roller and the other of which is a driven roller. The vulcanized sleeve 180 is then rotated and cut into predetermined widths, corresponding to the desired width of the belts 178, which thereby exposes the fibers 194 in the compression portion of the belts 178.

COMPARATIVE TESTING

The effectiveness of the invention was tested by comparing manufacture according to the invention with manufacture by conventional methods. Power consumption was determined for each method.

Inventive Test Belt

Figure 11:
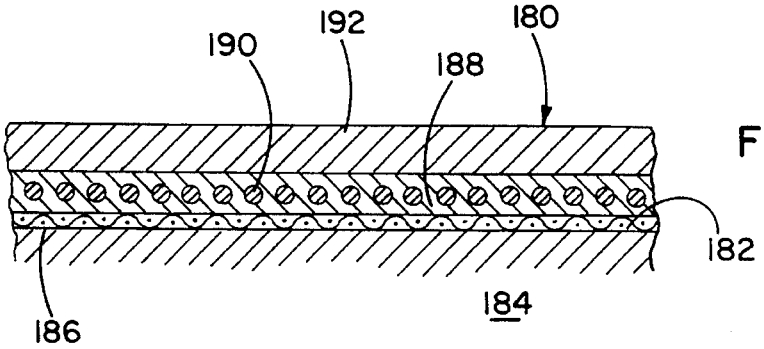
FIG. 11 is a cross-sectional view of a belt sleeve in inside out orientation on a forming drum/mandrel.
Figure 12:
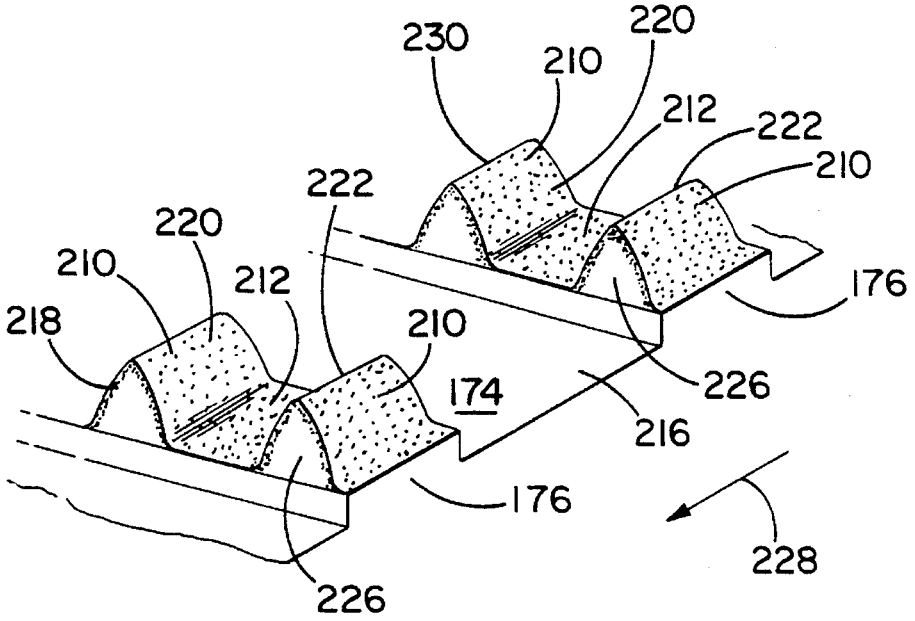
FIG. 12 is a fragmentary perspective view of a pair of abrading elements on the grinding wheel of the present invention.

The inventive test belt was a V-ribbed belt constructed on a forming drum with components as shown in FIG. 11. One ply of cover canvas 186 with plain fabric woven from cotton yarns, in both the warp and weft direction, was combined with a rubber-containing stretch woven fabric having a yarn cross angle of about 110°. This is known as "high-angle canvas". The cushion rubber layer 188 was made from chloroprene rubber. The load carrying cords were made from polyester fiber rope. The compression rubber layer 192 was made from chloroprene rubber having cut fiber yarns 194 therein. The yarns were a mixture of 8 volume % of 6 mm long nylon fiber and 3 volume % of 3 mm long aramid fiber aligned laterally with respect to the belt sleeve 180.

The belt sleeve 180 was vulcanized and mounted on a pair of rollers 14, 16, pretensioned, and rotated. The grinding wheel 158 was rotated at 1800 rpm in a direction opposite to the direction of rotation of the sleeve 180 and was brought into contact with the belt sleeve 180 to effect grinding thereof. Eighty grooves 196 were formed in the belt sleeve 180. The grooves 196 were approximately 2 mm deep. The grinding operation was completed in 3.5 minutes.

Each abrading element 176 of the grinding wheel 158 had a circumferential length P equal to approximately 30% of the circumferential pitch L of the abrading elements 176.

The power consumption required in the grinding operation was 0.385 kWh/cycle. The surface temperature of the grinding wheel 158 just after the grinding operation was completed was approximately 20°–35° C., while the surface temperature of the vulcanized belt sleeve was 25°–35° C.

Conventional Test Sample

The grinding operation was carried out under the same conditions as set forth above. However, the grinding wheel was made with a circumferential length P of each abrading element equal to about 80% of the circumferential pitch L. The grinding wheel had no granular material on the leading edge thereof.

The time required to complete the grinding operation was 5.8 minutes and the power consumption was approximately 1.024 kWh/cycle. The surface temperature of the grinding wheel at the completion of the grinding operation was 30°–55° C., while the surface temperature of the vulcanized sleeve was 30°–45° C.

In conclusion, the belt sleeve treated according to the invention required considerably less power to process. Because the grinding wheel and belt sleeve remained cooler during treatment, more consistent belt formation and longer grinding wheel life were anticipated.

The foregoing disclosure of specific embodiments is intended to be illustrative of the broad concepts comprehended by the invention.

We claim:

1. In combination:

a) a power transmission belt/belt sleeve having an exposed annular surface with a central axis;

b) means for mounting the belt/belt sleeve for continuous movement around the central axis; and c) a grinding wheel for treating the exposed annular surface of the power transmission belt/belt sleeve, said grinding wheel comprising:

a cylindrical body defining a rotational axis and having a circumferential outer surface with an axial extent; and a plurality of abrading elements arranged in circumferentially-spaced relationship on the outer surface of the cylindrical body and extending in substantially straight lines that are non-parallel to the axis of the grinding wheel body, there being reliefs between adjacent abrading elements to allow momentary release of pressure on the power transmission belt/belt sleeve surface being treated by the grinding wheel.

2. The combination according to claim 1 wherein a line extending parallel to the rotational axis of the grinding wheel along the outer surface of the grinding wheel body intercepts no more than two of the plurality of abrading elements.

3. In combination:

a) a power transmission belt/belt sleeve having an exposed annular surface with a central axis;

b) means for mounting the belt/belt sleeve for continuous movement around the central axis; and c) a grinding wheel for treating the exposed annular surface of the power transmission belt/belt sleeve, said grinding wheel comprising:

a cylindrical body defining a rotational axis and having a circumferential outer surface; and a plurality of abrading elements arranged in circumferentially-spaced relationship on the outer surface of the cylindrical body, there being reliefs between adjacent abrading elements to allow momentary release of pressure on the power transmission belt/belt sleeve surface being treated by the grinding wheel, each of the plurality of abrading elements having a circumferential length (P), each of the reliefs having a circumferential length (D), and the circumferential length (P) of the abrading elements being from 10 to 40% of a circumferential pitch length (L) for the abrading elements, where L=P+D.

4. The combination according to claim 3 wherein the circumferential length (P) of the abrading elements is from 30–40% of the circumferential pitch length (L).

5. The combination according to claim 3, wherein the plurality of abrading elements have a leading edge and the leading edge on each of the plurality of abrading elements is inclined so as to be non-parallel to a radial line through the axis of the body.

6. The combination according to claim 5 wherein the leading edge is inclined by no more than 45° with respect to a radial line through the axis of the body.

7. The combination according to claim 3 wherein the plurality of abrading elements have a leading edge and there is granular material applied to the leading edge of the abrading elements.

8. The combination according to claim 3 wherein there is granular material applied to the plurality of abrading elements to contact the power transmission belt/belt sleeve that is being treated, and the granular material comprises diamond having a mesh size of 100 to 120 microns.

9. In combination:

a) a power transmission belt/belt sleeve having an exposed annular surface with a central axis;

b) means for mounting the belt/belt sleeve for continuous movement around the central axis; and c) a grinding wheel for treating the exposed annular surface of the power transmission belt/belt sleeve, said grinding wheel comprising:

a cylindrical body defining a rotational axis and having a circumferential outer surface; and a plurality of abrading elements arranged in circumferentially-spaced relationship on the outer surface of the cylindrical body, there being reliefs between adjacent abrading elements to allow momentary release of pressure on the power transmission belt/belt sleeve surface being treated by the grinding wheel, each abrading element having a leading edge extending from the circumferential outer surface and the leading edge being swept back in a trailing direction where the leading edge extends from the circumferential outer surface.

10. The combination according to claim 9 wherein granular material is applied to the leading edge of the abrading element.

11. The combination according to claim 10 wherein the granular material comprises diamond having a mesh size of 100 to 120 microns.

12. The combination according to claim 9 wherein the leading edge is inclined by no more than 45° with respect to a radial line through the axis of the body.

13. The combination according to claim 9 wherein each of the plurality of abrading elements has a circumferential length (P), each of the reliefs has a circumferential length (D) and the circumferential length (P) of the abrading elements is from 10 to 40% of a circumferential pitch length (L) for the abrading elements, where L=P+D.

14. The combination according to claim 13 wherein the circumferential length (P) of the abrading element is from 30%–40% of the circumferential pitch length (L).

15. The combination according to claim 9 wherein each abrading element has a ridge extending circumferentially from the leading edge for a fixed distance.

16. The combination according to claim 15 wherein each abrading element has a trailing edge extending from the ridge to the circumferential outer surface and the trailing edge is swept back in a trailing direction as the trailing edge extends from the ridge to the circumferential outer surface.

* * * * *